US009872570B2

(12) United States Patent
Joyal

(10) Patent No.: US 9,872,570 B2
(45) Date of Patent: Jan. 23, 2018

(54) PORTABLE BUTTOCK AND FOOT SUPPORT DEVICE

(71) Applicant: Derek Joyal, Burnsville, MN (US)

(72) Inventor: Derek Joyal, Burnsville, MN (US)

( * ) Notice: Subject to any disclaimer, the term of this patent is extended or adjusted under 35 U.S.C. 154(b) by 175 days.

(21) Appl. No.: 14/706,961

(22) Filed: May 8, 2015

(65) Prior Publication Data

US 2016/0324325 A1 Nov. 10, 2016

(51) Int. Cl.
*A47C 9/10* (2006.01)
*A47C 7/50* (2006.01)
*A47C 9/02* (2006.01)

(52) U.S. Cl.
CPC ..... *A47C 9/10* (2013.01); *A47C 7/506* (2013.01); *A47C 9/025* (2013.01)

(58) Field of Classification Search
CPC ..... A47C 9/025; A47C 9/10; A47C 9/02
USPC ..... 297/187
See application file for complete search history.

(56) References Cited

U.S. PATENT DOCUMENTS 2,978,012 A * 4/1961 Norseen ..... A47C 4/20 108/116
3,414,323 A * 12/1968 Mitchum ..... A47C 4/20 248/121
3,467,033 A * 9/1969 Remer ..... A47C 9/10 108/115
3,477,673 A * 11/1969 Bereday ..... A47C 9/025 248/121
3,704,847 A * 12/1972 Schmitt ..... A47C 9/025 248/127
4,653,808 A * 3/1987 Opsvik ..... A47C 9/025 135/67
5,060,754 A * 10/1991 Feick ..... A47C 16/005 182/113
5,149,174 A * 9/1992 Charash ..... A47C 9/025 248/125.1
5,199,763 A * 4/1993 Wilder ..... A47C 9/025 297/15
5,553,921 A 9/1996 Schenk
5,579,864 A 12/1996 Sharrock
6,467,843 B1 * 10/2002 Rossborough ..... A47C 3/34 108/150
6,679,554 B2 1/2004 Anders
6,719,248 B2 * 4/2004 Lamont ..... A47C 9/025 248/121

(Continued)

FOREIGN PATENT DOCUMENTS

GB 2077581 12/1981
JP 8131295 5/1996

(Continued)

*Primary Examiner* — David R Dunn
*Assistant Examiner* — Tania Abraham

(57) ABSTRACT

A portable buttock and foot support device supports a user's buttocks and feet in a location where a conventional seat is not available. The device includes a base having a bottom surface, a top surface, and a perimeter edge extending around and between the top surface and the bottom surface. A buttock support is pivotally coupled to the base. The buttock support is positionable to extend upwardly relative to the top surface of the base. A foot support is pivotally coupled to the base. The foot support is positionable to extend upwardly relative to the top surface of the base. The foot support is positioned in spaced relationship to the buttock support.

6 Claims, 3 Drawing Sheets

(56) References Cited

U.S. PATENT DOCUMENTS

| | | | | |
|---|---|---|---|---|
| 6,823,806 | B1 * | 11/2004 | Buono | A47B 3/0912 108/132 |
| 7,108,321 | B2 | 9/2006 | Davis | |
| 7,137,937 | B2 | 11/2006 | Croft | |
| 7,632,223 | B2 | 9/2009 | Alexiadis | |
| 8,220,872 | B2 * | 7/2012 | Hong | A47C 3/30 297/312 |
| 2003/0075384 | A1 | 4/2003 | Pickering | |

FOREIGN PATENT DOCUMENTS

| | | | | |
|---|---|---|---|---|
| JP | 08131295 | A * | 5/1996 | |
| WO | WO0113768 | | 3/2001 | |
| WO | WO 0113768 | A1 * | 3/2001 | A47C 9/025 |

* cited by examiner

PORTABLE BUTTOCK AND FOOT SUPPORT DEVICE

BACKGROUND OF THE DISCLOSURE

Field of the Disclosure

The disclosure relates to support devices and more particularly pertains to a new support device for supporting a user's buttocks and feet in a location where a conventional seat is not available.

SUMMARY OF THE DISCLOSURE

An embodiment of the disclosure meets the needs presented above by generally comprising a base having a bottom surface, a top surface, and a perimeter edge extending around and between the top surface and the bottom surface. A buttock support is pivotally coupled to the base. The buttock support is positionable to extend upwardly relative to the top surface of the base. A foot support is pivotally coupled to the base. The foot support is positionable to extend upwardly relative to the top surface of the base. The foot support is positioned in spaced relationship to the buttock support.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
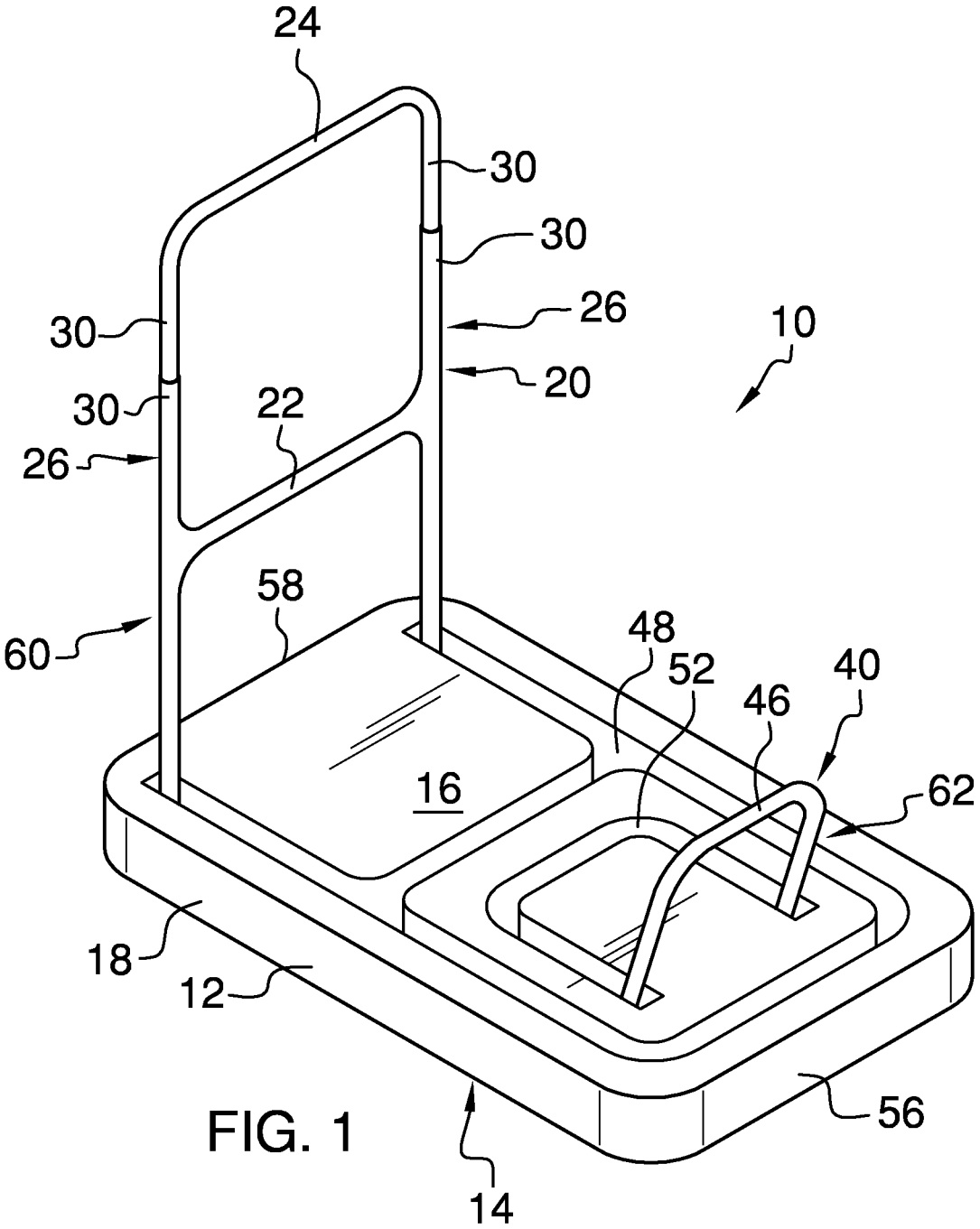
FIG. 1 is a top front side perspective view of a portable buttock and foot support device according to an embodiment of the disclosure.
Figure 2:
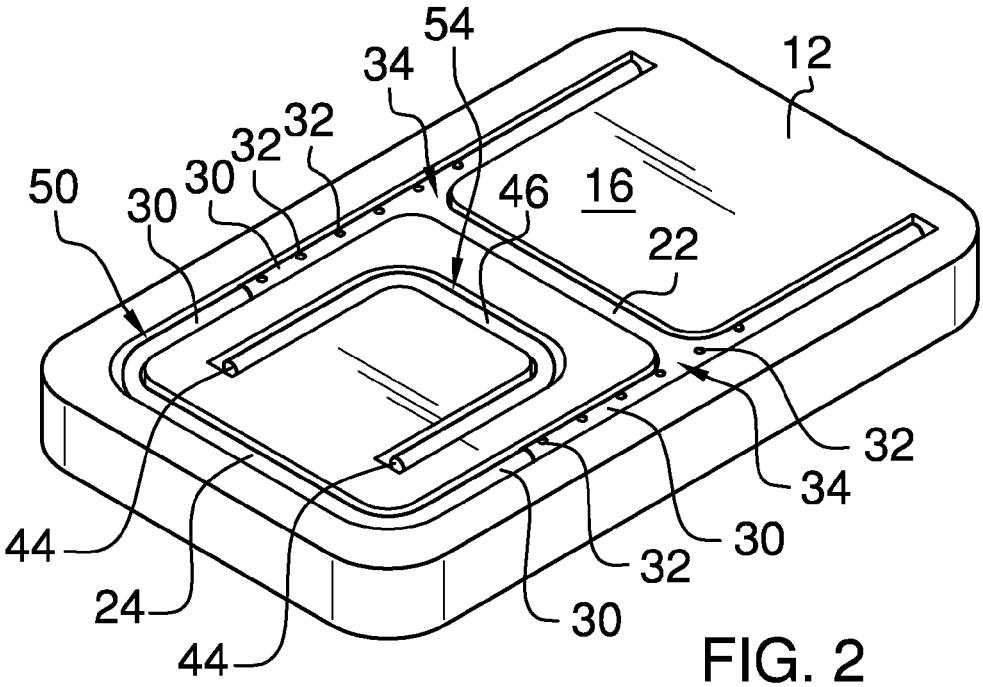
FIG. 2 is a top front side perspective view of an embodiment of the disclosure in a collapsed position.
Figure 3:
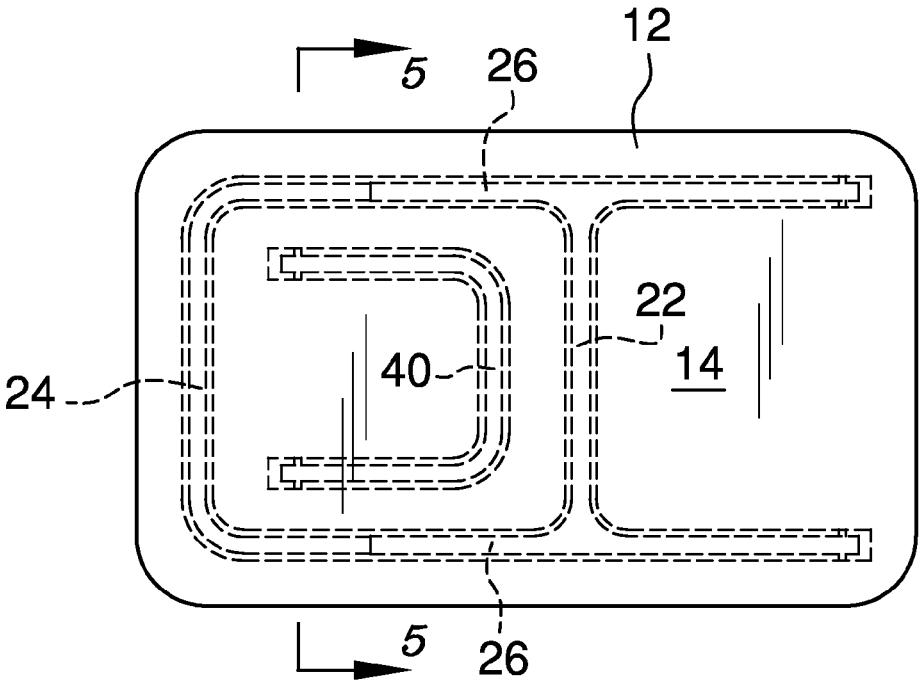
FIG. 3 is a bottom view of an embodiment of the disclosure.
Figure 4:
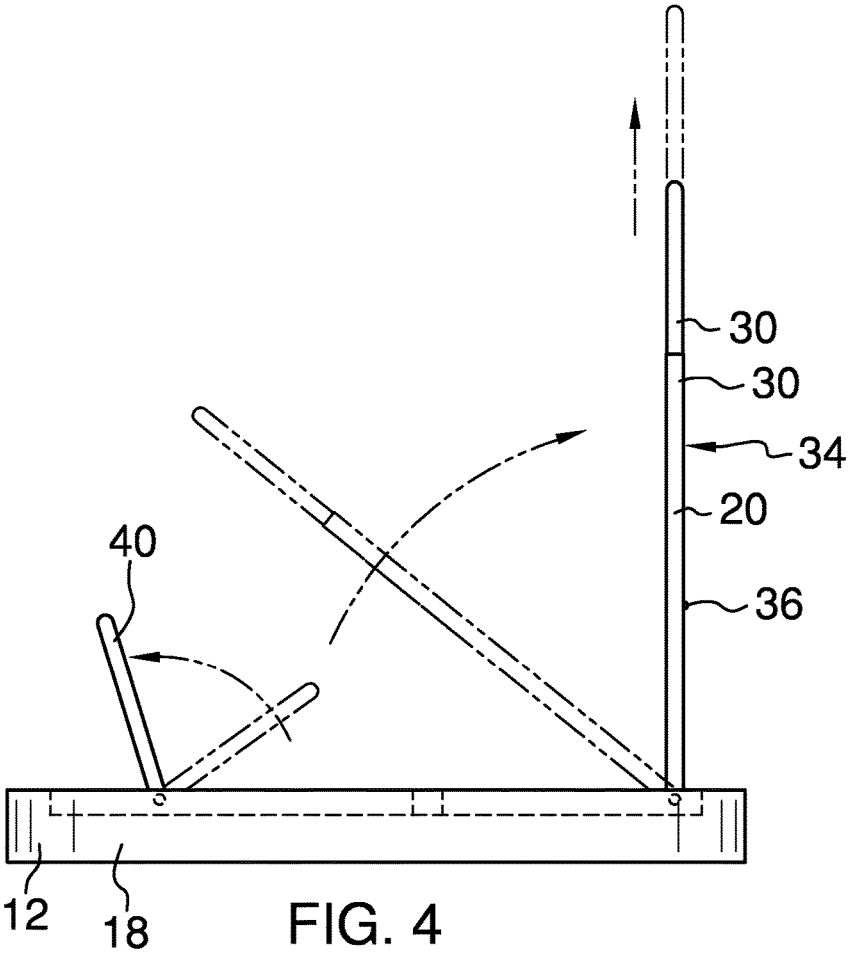
FIG. 4 is a side view of an embodiment of the disclosure.
Figure 5:
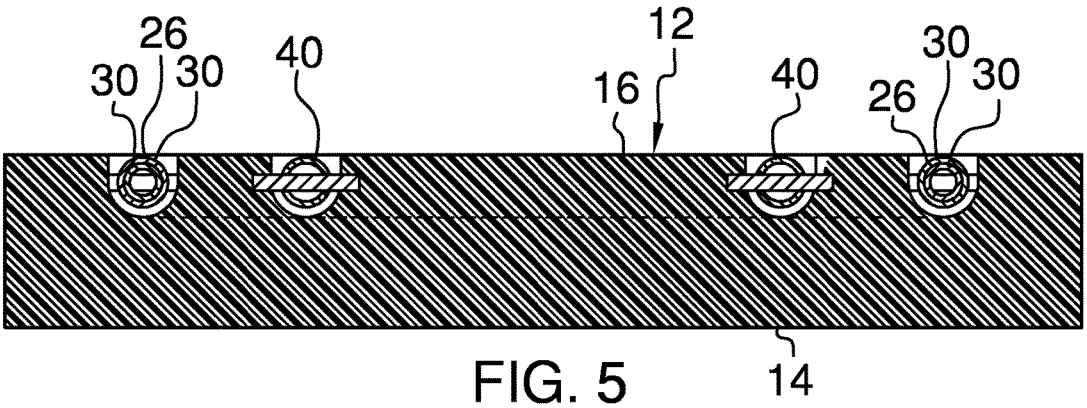
FIG. 5 is a cross-sectional view of an embodiment of the disclosure taken along line 5-5 of FIG. 3.

With reference now to the drawings, and in particular to FIGS. 1 through 5 thereof, a new support device embodying the principles and concepts of an embodiment of the disclosure and generally designated by the reference numeral 10 will be described.

As best illustrated in FIGS. 1 through 5, the portable buttock and foot support device 10 generally comprises a base 12 having a bottom surface 14, a top surface 16, and a perimeter edge 18 extending around and between the top surface 16 and the bottom surface 14. A buttock support 20 is pivotally coupled to the base 12. The buttock support 20 is positionable to extend upwardly relative to the top surface 16 of the base 12. The buttock support 20 includes a cross member 24 and a pair of lateral side members 26. The buttock support 20 further includes a brace 22 coupled to and extending between the lateral side members 26. The brace 22 is parallel to the cross member 24. Respective distal ends 28 of the lateral side members 26 relative to the cross member 24 are pivotally coupled to the base 12. Each of the lateral side members 26 is telescopic wherein a distance between the cross member 24 and the base 12 is adjustable. Each of the lateral side members 26 includes a pair of nested sections 30. Each of a plurality of holes 32 extends through a first one 34 of the nested sections 30. A respective locking member 36 is coupled to each lateral side member 26. The locking member 36 is engageable to a selectable one of the holes 32 in a conventional manner securing the nested sections 30 wherein each lateral side member 26 is configured to support a person leaning against the cross member 24. Each locking member 36 may be a pin, a biased protrusion of conventional design, or the like.

A foot support 40 is pivotally coupled to the base 12. The foot support 40 is positionable to extend upwardly relative to the top surface 16 of the base 12. The foot support 40 is positioned in spaced relationship to the buttock support 20. The foot support 40 is generally U-shaped having opposite ends 44 pivotally coupled to the base 12. A cross section 46 of the foot support 40 is positionable in spaced relationship to the buttock support 20 allowing a person to rest their feet on the cross section 46 of the foot support 40 while leaning against the buttock support 20.

A buttock support storage channel 48 extends into the top surface 16 of the base 12. The buttock support 20 is positioned in the buttock support storage channel 48 when the buttock support 20 is pivoted into a storage position 50. Similarly, a foot support storage channel 52 extends into the top surface 16 of the base 12. The foot support 40 is positioned in the foot support storage channel 52 when the foot support 40 is pivoted into a retracted position 54. Each of the foot support 40 and the buttock support 20 is positioned adjacent to a respective end 56,58 of the base 12 when the foot support 40 and the buttock support 20 are pivoted into respective deployed positions 60,62.

In use, the device 10 may be carried to a desired location. The base 12 is positioned on a supporting surface and the buttock support 20 and foot support 40 are pivoted from the buttock support storage channel 48 and the foot support storage channel 52 respectively. The person may then position their buttocks on or against the buttock support 20 and if desired, rest one or both feet on the foot support 40.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A portable buttock and foot support device:

a base having a bottom surface, a top surface, and a perimeter edge extending around and between said top surface and said bottom surface;

a buttock support being pivotally coupled to said base, said buttock support being positionable to extend upwardly relative to said top surface of said base, said buttock support comprising a cross member and a pair of lateral side members, respective distal ends of said lateral side members relative to said cross member being pivotally coupled to said base, each of said lateral side members being telescopic wherein a distance between said cross member and said base is adjustable;

a buttock support storage channel extending into said top surface of said base, said buttock support being positioned in said buttock support storage channel when said buttock support is pivoted into a storage position;

a foot support being pivotally coupled to said base, said foot support being positionable to extend upwardly relative to said top surface of said base, said foot support being positioned in spaced relationship to said buttock support; and a foot support storage channel extending into said top surface of said base, said foot support being positioned in said foot support storage channel when said foot support is pivoted into a retracted position.

2. The device of claim 1, further comprising said buttock support further including a brace coupled to and extending between said lateral side members.

3. The device of claim 2, further comprising said brace being parallel to said cross member.

4. The device of claim 1, further comprising:

each of said lateral side members comprising a pair of nested sections;

a plurality of holes extending through a first one of said nested sections; and a respective locking member coupled to each said lateral side member, said locking member being engageable to a selectable one of said holes wherein each said lateral side member is configured to support a person leaning against said cross member.

5. The device of claim 1, further comprising each of said foot support and said buttock support being positioned adjacent to a respective end of said base when said foot support and said buttock support are pivoted into respective deployed positions.

6. A portable buttock and foot support device:

a base having a bottom surface, a top surface, and a perimeter edge extending around and between said top surface and said bottom surface;

a buttock support being pivotally coupled to said base, said buttock support being positionable to extend upwardly relative to said top surface of said base, said buttock support comprising a cross member and a pair of lateral side members, said buttock support further including a brace coupled to and extending between said lateral side members, said brace being parallel to said cross member, respective distal ends of said lateral side members relative to said cross member being pivotally coupled to said base, each of said lateral side members being telescopic wherein a distance between said cross member and said base is adjustable, each of said lateral side members comprising a pair of nested sections;

a plurality of holes extending through a first one of said nested sections; and a respective locking member coupled to each said lateral side member, said locking member being engageable to a selectable one of said holes wherein each said lateral side member is configured to support a person leaning against said cross member;

a foot support being pivotally coupled to said base, said foot support being positionable to extend upwardly relative to said top surface of said base, said foot support being positioned in spaced relationship to said buttock support;

a buttock support storage channel extending into said top surface of said base, said buttock support being positioned in said buttock support storage channel when said buttock support is pivoted into a storage position;

a foot support storage channel extending into said top surface of said base, said foot support being positioned in said foot support storage channel when said foot support is pivoted into a retracted position; and each of said foot support and said buttock support being positioned adjacent to a respective end of said base when said foot support and said buttock support are pivoted into respective deployed positions.

* * * * *